US008487541B2

(12) United States Patent
Roberts et al.

(10) Patent No.: US 8,487,541 B2
(45) Date of Patent: Jul. 16, 2013

(54) METHOD TO ENSURE BALLAST STARTING REGARDLESS OF HALF CYCLE INPUT

(75) Inventors: Bruce Roberts, Mentor-on-the-Lake, OH (US); Timothy Chen, Aurora, OH (US)

(73) Assignee: General Electric Company, Schenectady, NY (US)

( * ) Notice: Subject to any disclaimer, the term of this patent is extended or adjusted under 35 U.S.C. 154(b) by 304 days.

(21) Appl. No.: 12/901,711

(22) Filed: Oct. 11, 2010

(65) Prior Publication Data

US 2012/0086351 A1 Apr. 12, 2012

(51) Int. Cl.
*H05B 37/02* (2006.01)

(52) U.S. Cl.
USPC ..... 315/224; 315/291; 315/307

(58) Field of Classification Search
USPC ..... 315/209 R, 224, 225, 226, 291, 307
See application file for complete search history.

(56) References Cited

U.S. PATENT DOCUMENTS

| | | | | |
|---|---|---|---|---|
| 5,825,136 | A * | 10/1998 | Rudolph | 315/291 |
| 5,962,985 | A | 10/1999 | Buij et al. | |
| 6,023,132 | A * | 2/2000 | Crouse et al. | 315/307 |
| 6,051,934 | A | 4/2000 | Nerone | |
| 6,137,235 | A * | 10/2000 | Franck | 315/224 |
| 6,198,231 | B1 * | 3/2001 | Schemmel et al. | 315/225 |
| 6,650,514 | B2 * | 11/2003 | Schmitt | 361/18 |
| 7,436,124 | B2 | 10/2008 | Nerone et al. | |
| 2003/0227263 | A1 * | 12/2003 | Benensohn | 315/224 |
| 2008/0088251 | A1 | 4/2008 | Gahalaut | |
| 2009/0153067 | A1 * | 6/2009 | Nerone | 315/209 R |
| 2010/0213850 | A1 | 8/2010 | Nerone | |

OTHER PUBLICATIONS

PCT/US2011/052249 International Search and Written Opinion.

* cited by examiner

*Primary Examiner* — Tung X Le
(74) *Attorney, Agent, or Firm* — Fay Sharpe LLP

(57) ABSTRACT

A ballast circuit (6) comprises a rectifier circuit (8) and dual starting circuits (11, 13) that ensure ballast startup and lamp ignition regardless of input waveform half cycle. The first starting circuit comprises resonant circuit (10), and the second starting circuit includes a resistor (11). The resistor (11) comprising the second startup circuit provides a bias resistance to the second switches (72) to ensure ballast startup when an oscillating input waveform is in a negative phase.

17 Claims, 3 Drawing Sheets

METHOD TO ENSURE BALLAST STARTING REGARDLESS OF HALF CYCLE INPUT

BACKGROUND OF THE DISCLOSURE

Classical non-active power factor corrected (PFC) ballasts use small capacitors and an output waveform that follows the input waveform to achieve acceptable power factor. This can lead to problems in the starting of a self oscillating resonant circuit. A ballast inverter in such ballasts typically only starts up on one of two input half cycles, which causes a delay in starting at the minimum and at its worst case of skipping starting of every other half cycle, causes the ballast to operate at half power. That is, for non-active PFC ballasts, there is no constant direct current (DC) bus feeding the resonant inverter in the ballast, and therefore the ballast needs to start on every one of the rectified positive and negative phases of the alternating current (AC) input provided to the inverter.

A ballast is an electrical device which is used to provide power to a load, such as an electrical lamp, and to regulate the current provided to the load. For fluorescent lamps, the ballast provides high voltage to start a lamp by ionizing sufficient plasma (vapor) for the arc to be sustained and to grow. Once the arc is established, the ballast allows the lamp to continue to operate by providing proper controlled current flow to the lamp. The term driver is also used to describe this type of power supply that regulates power to loads such as LEDs, OLEDs, CFLs, and many other non lighting loads.

Accordingly, there is an unmet need in the art for systems and methods that facilitate reliably starting a ballast circuit regardless of input half cycle, and for overcoming the deficiencies noted above.

SUMMARY OF THE DISCLOSURE

In accordance with one aspect, a ballast circuit with dual starting circuits for igniting a lamp regardless of input half cycle comprises a first starting circuit comprising a self-oscillating resonant circuit that includes at least two lamp leads and a resonant inductor that induces a voltage proportional to an instantaneous rate of change of current in the resonant circuit in two driving inductors that drive first and second switches, the driving inductors being mutually coupled to the resonant inductor. The ballast further comprises a second starting circuit comprising a bias resistor. The bias resistor causes the ballast circuit to start regardless of input half cycle.

In accordance with another aspect, a ballast circuit with dual starting circuits for igniting a lamp regardless of input half cycle comprises a self-oscillating resonant circuit that includes at least two lamp leads and a resonant inductor that induces a voltage across first and second switches, wherein the resonant circuit operates as a first starting circuit. The ballast further comprises a second starting circuit comprising a bias resistor. The bias resistor causes the ballast circuit to start regardless of input half cycle.

DETAILED DESCRIPTION OF THE EMBODIMENTS

The following description relates to a ballast circuit that solves the problem of unreliable startup due to input half cycle. Advantages of the described circuit design include that the ballast circuit starts regardless of input half cycle and without requiring an active PFC circuit. That this feature makes the ballast more compact, requires fewer electrical components, and is less expensive than ballasts that employ an active PFC circuit will be obvious to those experienced in the arts.

Figure 1:
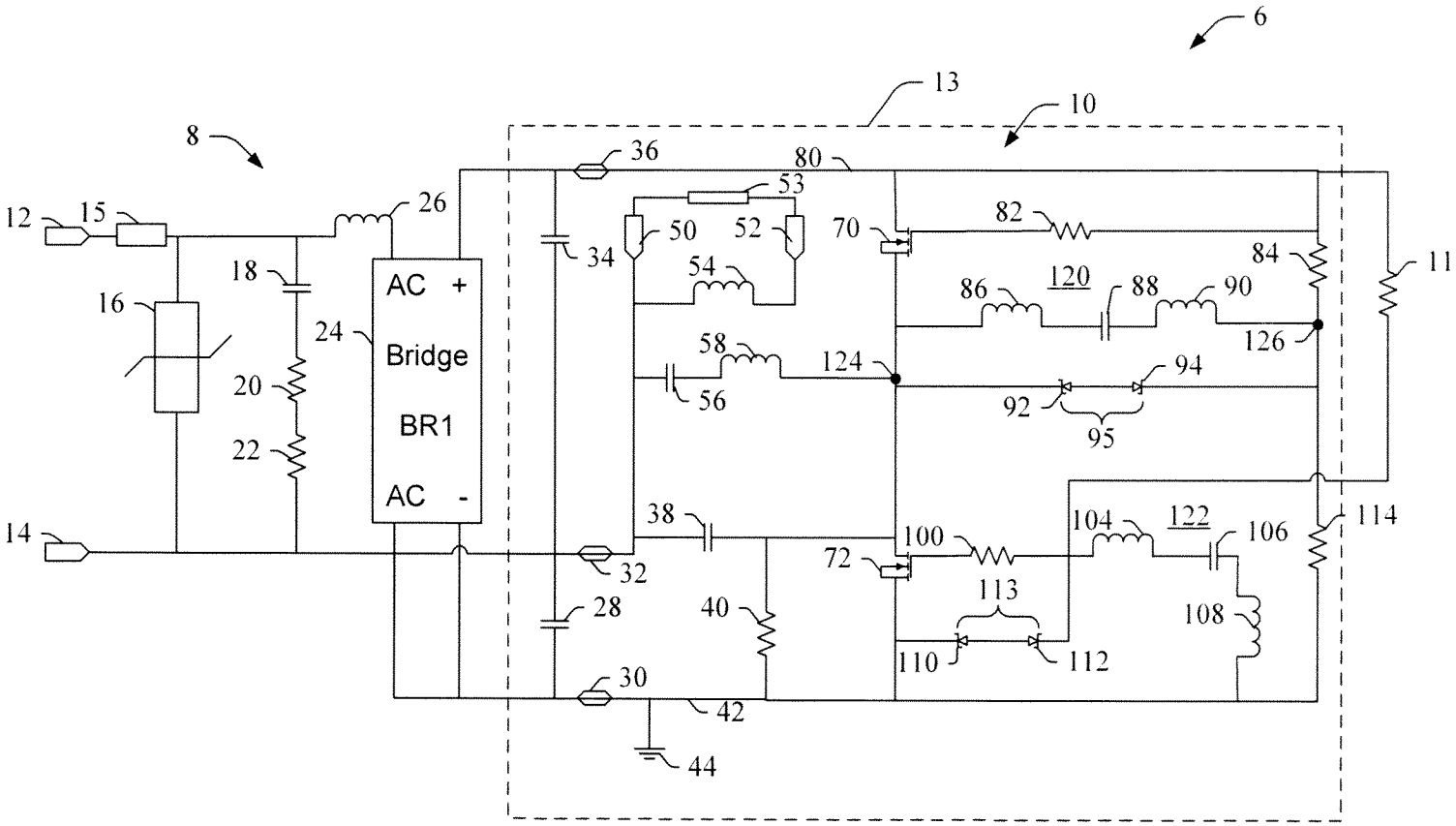
FIG. 1 illustrates a circuit comprising a rectifier circuit and a self-oscillating resonant circuit or network that drives one or more lamps and includes a resistor that provides a bias resistance to ensure ballast start during either and both of a positive input phase and a negative input phase.

FIG. 1 illustrates a circuit 6 comprising a rectifier circuit 8 and a self-oscillating resonant circuit or network 10 that drives one or more lamps and includes a resistor 11 that provides a bias resistance to ensure ballast start during either and both of a positive input phase and a negative input phase. The circuit 6 facilitates reliable ballast starting even in the absence of a power factor correction (PFC) circuit, such as where a ballast does not have access to a constant direct current (DC) bus feeding an inverter therein. The ballast circuit includes two separate starting circuits (e.g., the first starting circuit 13 including the resonant circuit 10, and the resistor 11 being the second starting circuit) on the resonant inverter to ensure that no starting delays occur, regardless of input phase. Using dual starting circuits solves the problem of a ballast starting only on a positive or negative input half cycle. The circuit 6 can be applied, for example, to small power circuits such as electronic low voltage halogen and compact fluorescent products that do not use active PFC but employ a small or no-holdup bus capacitor or the like in order to achieve high power factor.

The ballast circuit 6 is coupled to an input line 12 and a neutral line 14. The input line 12 is coupled to a fuse 15, which in turn is coupled to over voltage protection device 16, and a capacitor 18. The capacitor 18 is coupled in series to a resistor 20, which is in turn coupled in series to a resistor 22. It will be appreciated by those of skill that the serially connected resistors can be replaced by a single resistor having a resistance equivalent to the sum of the resistances of the resistors 20 and 22. The resistor 22 is coupled to the neutral line 14 and to a bridge 24, which in turn is coupled to the input line 12 via an inductor 26.

The neutral line 14 is further coupled to the diode bridge 24, and to capacitor 28 that is coupled across two optional connectors or couplings 30, 32, which are also coupled to the neutral line 14. For instance, in one embodiment, the rectifier circuit 8 is located on a first circuit board (not shown) and the resonant circuit 10 is located on a second circuit board (not shown). The connecters 30, 32 facilitate this orientation by making the necessary connections between the inverter circuit 8 and the resonant circuit 10. A capacitor 34 is coupled to each of the connector 32 and an optional connector 36, as well as to a positive terminal of the bridge 26 and the neutral line 14. It will be appreciated that the connectors 30, 32, 36 may be omitted from the herein-described ballast circuit 6 in an arrangement wherein the rectifier circuit 8 and the resonant circuit 10 are arranged on a single circuit board.

The connector 32 is coupled to a capacitor 38, which is further coupled to a resistor 40. The resistor 40 is coupled to a bus 42, which in turn is coupled to the connector 30 and to ground 44. A pair of a leads 50, 52 are coupled to a lamp 53 and have an inductor 54 coupled thereacross, and the lamp lead 50 and inductor 54 are further coupled to a capacitor 56, which is in turn coupled to an inductor 58. The lamp lead 50, inductor 54, and capacitor 56 are further coupled to the connector 32 and the capacitor 38.

The inductor 58 is coupled to a bus 60 that connects the inductor 58 to a drain of a first switch 70 (e.g., a MOSFET) and to a source of a second switch 72 (e.g., a MOSFET). In one embodiment, the first and second switches are both n-type devices. In another embodiment, the first and second switches are both p-type devices. In a third embodiment, one each of P type and N type MOSFETS are utilized. A drain of the MOSFET 70 is coupled to a bus 80 that is connected to the optional connector 36. A gate of the MOSFET 70 is coupled to a resistor 82, which is further coupled to a resistor 84 and to the bus 80. The bus 60 is further coupled to an inductor 86 that is further coupled to a capacitor 88. The capacitor 88 is coupled to an inductor 90, which is coupled to the resistor 84.

The bus 60 is also coupled to a cathode of a Zener diode 92. The anode of the Zener diode 92 is coupled to an anode of a Zener diode 94, and a cathode of the Zener diode 94 is coupled to the resistor 84 and the inductor 90. Together, the Zener diodes 92, 94 form a bi-directional voltage clamp 95 that clamps positive and negative excursions of gate-to-source voltage to respective limits determined by the voltage ratings of the back-to-back Zener diodes 92, 94.

The gate of the MOSFET 72 is coupled to a resistor 100, which is coupled to the resistor 11. An inductor 104 is coupled to the resistor 100, and to a capacitor 106 that is further coupled to an inductor 108. The inductor 108 is coupled to the bus 42, to a cathode of a Zener diode 110. and to a source of the MOSFET 72. The anode of the Zener diode 110 is coupled to an anode of a Zener diode 112, and a cathode of the Zener diode 112 is coupled to the resistors 11, 100, and the inductor 104. A resistor 114 is coupled to the bus 42, to the resistor 84, the inductor 90, and the cathode of the Zener diode 94.

With continuing reference to FIG. 1, first and second gate drive circuitry or circuit, generally designated 120, 122, is connected between nodes 124, 126 and includes first and second driving inductors 86, 108, which are secondary windings mutually coupled to the resonant inductor 58 to induce in the driving inductors 86, 108 voltage proportional to the instantaneous rate of change of current in the resonant circuit 10. First and second secondary inductors 90, 104 are serially connected to the respective first and second driving inductors 86, 108 via first and second capacitors 88, 106. The gate drive circuitry 120, 122 is used to control the operation of the respective upper and lower switches 70, 72. More particularly, the gate drive circuitry 120, 122 maintains the upper switch 70 "ON" for a first half of a cycle and the lower switch 72 "ON" for a second half of the cycle. An oscillating signal waveform is generated at the node 124 and is used to excite the resonant circuit 10. In one example, an oscillation signal is generated by the resonant circuit (10) at the common node 124, wherein the oscillation signal determines a switching rate of the first and second switches (70, 72).

First and second bi-directional voltage clamps 95, 113 are connected in parallel to the secondary inductors 90, 104 respectively, each including a pair of back-to-back Zener diodes. The bi-directional voltage clamps 95, 113 act to clamp positive and negative excursions of gate-to-source voltage to respective limits determined by the voltage ratings of the back-to-back Zener diodes. Each bi-directional voltage clamp 95, 113 cooperates with the respective first or second secondary inductor 90, 104 so that the phase angle between the fundamental frequency component of voltage across the resonant circuit 10 and the AC current in the resonant inductor 58 approaches zero during ignition of the lamps.

Serially connected resistors 84, 114 cooperate with a resistor 40, connected between the common node 124 and the common conductor 42, for starting regenerative operation of the gate drive circuits 120, 122. Upper and lower capacitors 88, 106 are connected in series with the respective first and second secondary inductors 90, 104. In the starting process, the capacitor 88 is charged via the resistors 40, 84, 114. The voltage across the capacitor 88 is initially zero, and, during the starting process, the serially-connected inductors 86 and 90 act as a short circuit, due to a relatively long time constant fur charging of the capacitor 88. When the capacitor 88 is charged to the threshold voltage of the gate-to-source voltage of the switch 70, (e.g., 2-3 volts), the switch 70 turns ON, which results in a small bias current flowing through the switch 70. The resulting current biases the switch 70 in a common drain, Class A amplifier configuration. This produces an amplifier of sufficient gain such that the combination of the resonant circuit 10 and the gate control circuit 120 produces a regenerative action that starts the inverter into oscillation, near the resonant frequency of the network including the capacitor 88 and inductor 90. If this normal starting operation does not operate properly due the biasing of the input half cycle, then the secondary starting circuit will bias the switch 72 and start the resonant circuit by initiating the lower switch to conduct first. After successful starting, the generated frequency is above the resonant frequency of the resonant circuit 10, which allows the inverter 8 to operate above the resonant frequency of the resonant network 10. This produces a resonant current which lags the fundamental of the voltage produced at the common node 124, allowing the inverter 8 to operate in a soft-switching mode prior to igniting the lamp(s). Thus, the inverter 8 starts operating in the linear mode and transitions into the switching Class D mode. Then, as the current builds up through the resonant circuit 10, the voltage increases to ignite the lamp(s), while maintaining the soft-switching mode, through ignition and into the conducting, arc mode of the lamps.

During steady state operation of the ballast circuit 6, the voltage at the common node 124 is a square wave. The bias voltage that once existed on the capacitor 88 diminishes. The frequency of operation is such that a first network including the capacitor 88 and inductor 90 and a second network including the capacitor 106 and inductor 104 are equivalently inductive. That is, the frequency of operation is above the resonant frequency of the identical first and second networks. This results in the proper phase shift of the gate circuit to allow the current flowing through the inductor 48 to lag the fundamental frequency of the voltage produced at the common node 124. Thus, soft-switching of the inverter 8 is maintained during the steady-state operation.

According to an example, in which component values are given for illustrative purposes only and without limiting the embodiments described herein, the voltage source 16 is provides a voltage of approximately 270V. The capacitor 18 may be a 22 nF capacitor, and the resistors 20, 22 may be 1.1kΩ resistors. The inductor 24 may be a 6 mH inductor, and the bridge 26 may be an MB6S (0.5A) bridge rectifier. The capacitors 28, 34 may be 47 nF capacitors, and the capacitor 38 may be a 1 nF capacitor. The resistor 40 may be a 120K resistor, and the capacitor 56 may be a 0.33 μF capacitor. The inductors 54, 58, 86, and 108 may be 1 mH inductors, and the inductors 90, 104 may be 1.5 mH inductors. It will be appreciated that the inductors 54, 58, 86, and 108 form a first transformer, while the inductors 90 and 104 form a second transformer.

To further this example, the MOSFETs 70, 72 may be FDU6N50 MOSFETs, and the resistors 82 and 100 may be 10kΩ resistors. Resistors 84 and 114 may be 512kΩ resistors, and resistor 11 may be a 560kΩ resistor. Capacitors 88 and 106 may be 5600 pF capacitors. Zener diodes 92 and 110 may be 14V D1N4744 diodes, and Zener diodes 94 and 112 may be 7.5V D1N4744 diodes. Different values of the Zener diodes 92, 110 and 94, 112 of the voltage clamps 95, 113 are useful in allowing the ballast 6 to change the current and subsequently the power provided to the lamp(s). As known in the art, in an instant start ballast, the initial mode of the lamp operation is glow. In the glow mode, the voltage across the lamp electrodes is high, for example, greater than 300V. The current which flows in the lamp is typically lower than the running current, for example, 40 or 50 mA instead of 180 mA. The electrodes heat up and become thermionic. Once the electrodes become thermionic, the electrodes emit electrons into the plasma and the lamp ignites. Once the lamp ignites, the impedance of the load shifts, causing the resonant frequency to shift to a state where the ballast runs at its nominal current.

Figure 2:
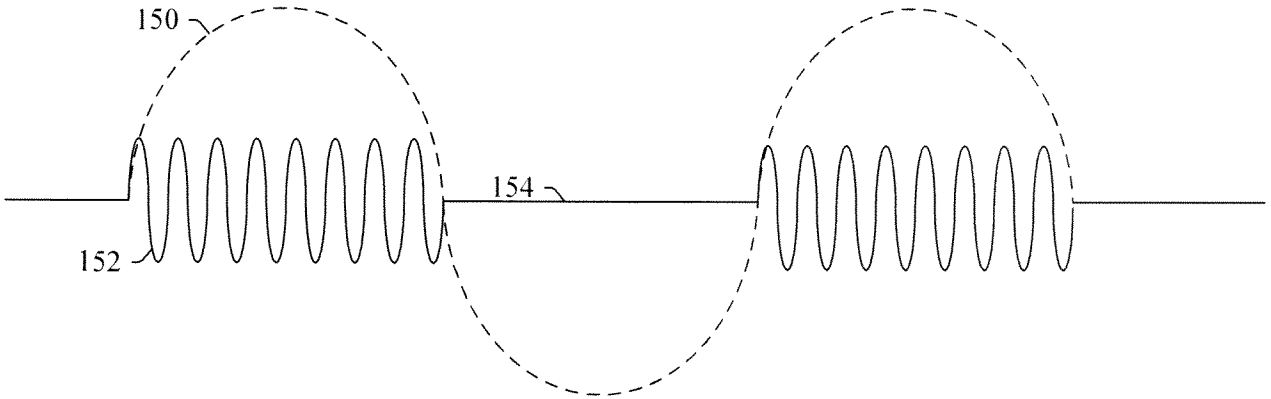
FIG. 2 illustrates an input waveform and a resultant output waveform as seen by a lamp coupled to leads in a ballast circuit that does not employ the bias resistor.

With continued reference to FIG. 1, FIG. 2 illustrates an input waveform 150 and a resultant output waveform 152 as seen by a lamp coupled to the leads 50, 52 in a ballast circuit that does not employ the bias resistor 11. When the input waveform 150 is positive, the output waveform 152 oscillates between positive and negative values, and starts the ballast 6. However, when the input waveform 150 is negative, the output waveform is absent, as shown be the segment 154. Thus, such a ballast circuit can only start during a positive half cycle of an input voltage. Provided to the circuit.

Figure 3:
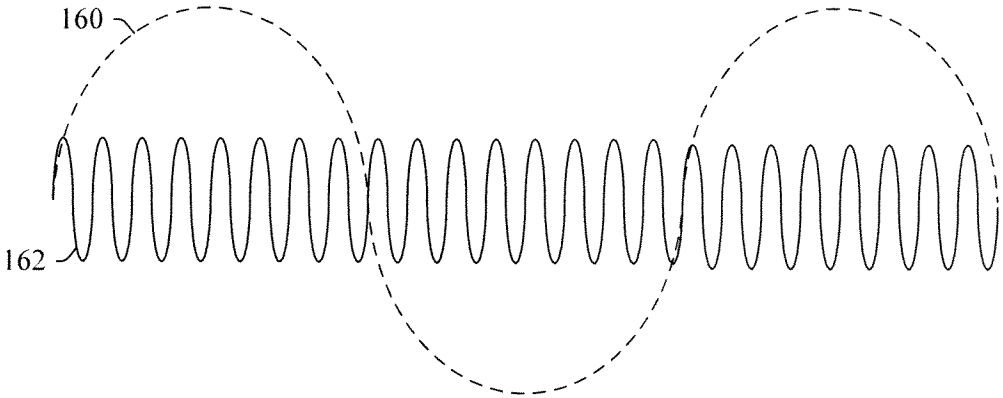
FIG. 3 illustrates an input waveform and a resultant output waveform that is seen by a lamp coupled to lamp leads in the ballast circuit of FIG. 1, which includes the bias resistor.

FIG. 3 illustrates an input waveform 160 and a resultant output waveform 162 that is seen by a lamp (not shown) coupled to lamp leads 50, 52 in the ballast circuit of FIG. 1, which includes the leakage resistor 11. Since both upper and lower MOSFETS can be started at any voltage input polarity or level, this ensures starting of the ballast circuit 6 regardless of input voltage half cycle. In this sense, the resistor 11 comprises a second "start circuit" for the ballast 6, and provides a leakage resistance through MOSFET 72 to ensure ballast starting during either input phase.

The invention has been described with reference to the various embodiments. Obviously, modifications and alterations will occur to others upon reading and understanding the preceding detailed description. This invention has been described in terms of a fluorescent ballast, but it should be apparent to those skilled in the arts that this circuit can apply to all manners of lighting device such as LEDs, OLEDs, and Halogen Lamps for example. It should also be apparent that this methodology could be even more generally applied to any self resonant power supply. It is intended that the invention be construed as including all such modifications and alterations.

What is claimed is:

1. A ballast circuit (6) with dual starting circuits for igniting a lamp (53) regardless of input half cycle, comprising:

a first starting circuit (13) comprising a self-oscillating resonant circuit (10) that includes at least two lamp leads (50, 52) and a resonant inductor (58) that induces a voltage proportional to an instantaneous rate of change of current in the resonant circuit (10) in two driving inductors (86, 108) that drive first and second switches (70, 72), the driving inductors being mutually coupled to the resonant inductor; and a second starting circuit comprising a bias resistor (11);

wherein the bias resistor (11) causes the ballast circuit (6) to start regardless of whether the input half cycle is positive or negative.

2. The ballast circuit according to claim 1, wherein the first and second switches (70, 72) include n-type devices.

3. The ballast circuit according to claim 1, wherein the first and second switches (70, 72) metal oxide silicon field effect transistors (MOSFETs).

4. The ballast circuit according to claim 1, wherein the lamp (53) is a low-voltage halogen lamp.

5. The ballast circuit according to claim 1, wherein the lamp (53) is a compact fluorescent lamp.

6. The ballast circuit according to claim 1, wherein the first and second switches (70, 72) include p-type devices.

7. The ballast circuit according to claim 1, wherein the first and second switches (70, 72) are coupled together at a common node (124) to receive an oscillation signal generated by the resonant circuit (10), wherein the oscillation signal determines a switching rate of the first and second switches (70, 72).

8. The ballast circuit according to claim 1, further including first and second bi-directional voltage clamps (95, 113), each operationally connected between a common node (124) and a control node (126), and which limit positive and negative excursions of voltage at the control node (126) with respect to the common node (124).

9. A ballast circuit (6) with dual starting circuits for igniting a lamp (53) regardless of input half cycle, comprising:

a self-oscillating resonant circuit (10) that includes at least two lamp leads (50, 52) and a resonant inductor (58) that induces a voltage across first and second switches (70, 72), wherein the resonant circuit (10) operates as a first starting circuit; and a second starting circuit comprising a bias resistor (11);

wherein the bias resistor (11) causes the ballast circuit (6) to start regardless of input half cycle by providing an output waveform that oscillates between positive and negative values and starts the ballast circuit when an input waveform provided to the ballast circuit is in either of a positive or negative half cycle.

10. The ballast circuit according to claim 9, wherein the first and second switches (70, 72) include n-type devices.

11. The ballast circuit according to claim 9, wherein the first and second switches (70, 72) metal oxide silicon field effect transistors (MOSFETs).

12. The ballast circuit according to claim 9, wherein the lamp (53) is a low-voltage halogen lamp.

13. The ballast circuit according to claim 9, wherein the lamp (53) is a compact fluorescent lamp.

14. The ballast circuit according to claim 9, wherein the first and second switches (70, 72) include p-type devices.

15. The ballast circuit according to claim 9, wherein the first and second switches (70, 72) are coupled together at a common node (124) to receive an oscillation signal generated by the resonant circuit (10), wherein the oscillation signal determines a switching rate of the first and second switches (70, 72).

16. The ballast circuit according to claim 9, further including first and second bi-directional voltage clamps (95, 113), each operationally connected between a common node (124) and a control node (126), and which limit positive and negative excursions of voltage at the control node (126) with respect to the common node (124).

17. The ballast circuit according to claim 9, wherein the resonant inductor (58) induces a voltage proportional to an instantaneous rate of change of current in the resonant circuit (10) in two driving inductors (86, 108) that drive the first and second switches (70, 72), the driving inductors (86, 108) being mutually coupled to the resonant inductor (58).

* * * * *